US006343573B1

(12) United States Patent
Takahashi

(10) Patent No.: US 6,343,573 B1
(45) Date of Patent: Feb. 5, 2002

(54) THERMOSTAT DEVICE

(75) Inventor: Masanori Takahashi, Kiyose (JP)

(73) Assignee: Nippon Thermostat Co., Ltd., Tokyo (JP)

( * ) Notice: Subject to any disclaimer, the term of this patent is extended or adjusted under 35 U.S.C. 154(b) by 0 days.

(21) Appl. No.: 09/642,662

(22) Filed: Aug. 22, 2000

(51) Int. Cl.[7] ..... F01P 7/14
(52) U.S. Cl. ..... 123/41.1; 123/41.08
(58) Field of Search ..... 123/41.08, 41.09, 123/41.1, 41.44

(56) References Cited

U.S. PATENT DOCUMENTS

| | | | | | |
|---|---|---|---|---|---|
| 4,662,320 | A | | 5/1987 | Moriya | 123/41.44 |
| 4,938,185 | A | | 7/1990 | Doke | 123/195 C |
| 5,111,775 | A | * | 5/1992 | Sumida et al. | 123/41.1 |
| 5,113,807 | A | | 5/1992 | Kobayashi | 123/41.74 |
| 5,216,984 | A | | 6/1993 | Shimano et al. | 123/41.44 |
| 5,427,062 | A | * | 6/1995 | Chamot et al. | 123/41.1 |
| 5,482,010 | A | * | 1/1996 | Lemberger et al. | 123/41.1 |
| 5,503,118 | A | | 4/1996 | Hollis | 123/41.44 |
| 5,638,774 | A | | 6/1997 | Albertson et al. | 123/41.33 |
| 5,715,776 | A | | 2/1998 | Seidl | 123/41.1 |
| 5,950,576 | A | * | 9/1999 | Busato et al. | 123/41.08 |
| 5,970,927 | A | | 10/1999 | Suzuki | 123/41.29 |
| 5,979,373 | A | * | 11/1999 | Sano | 123/41.1 |
| 5,992,755 | A | | 11/1999 | Kuze | 236/34.5 |
| 6,050,495 | A | * | 4/2000 | Suda et al. | 236/34.5 |
| 6,112,706 | A | * | 9/2000 | Heer | 123/41.1 |

* cited by examiner

*Primary Examiner*—Henry C. Yuen
*Assistant Examiner*—Hai Huynh
(74) *Attorney, Agent, or Firm*—Sughrue Mion, PLLC

(57) ABSTRACT

A system for controlling coolant flow in an engine includes a housing where coolant from a radiator and a bypass passage are mixed, the housing enclosing: a water pump having an impeller, a heat responding element downstream from the impeller and having a piston that extends when a temperature is above a predetermined amount, a linkage connected to the piston, and a valve upstream from the impeller and connected to the linkage so extension of the piston causes the valve to open so radiator coolant flows. A bypass valve also upstream from the impeller is connected to the linkage so extension of the piston causes adjustment of opening of the bypass valve, coolant from the bypass passage flowing when the bypass valve is open. The two valves are ganged so total flow is kept constant. A thermistor accelerates the action of the piston by quickly heating the element.

16 Claims, 7 Drawing Sheets

THERMOSTAT DEVICE

BACKGROUND OF THE INVENTION

1. Field of the Invention

The present invention relates to a thermostat that controls coolant flow of an internal combustion engine, and more particularly to a thermostat and water pump in an integrated housing.

2. Description of the Prior Art

Although traditionally thermostats were mounted at the outlet of engines, recently they are being mounted on a coolant inlet side of the engine. The coolant flows through a water jacket (not shown) of the engine block 3. For medium to large size engines, as shown in FIGS. 1A and 1B, a thermostat 7 is placed upstream and adjacent the inlet of a water pump ensuring a relatively larger flow of coolant into the bypass passage 6 when the thermostat 7 is closed. A cooling system 1 causes the flow to be directed through a radiator 2 when the engine 3 is warmed up.

U.S. Pat. No. 4,938,185 granted to Doke, incorporated herein by reference, discloses a one-piece structure that includes a coolant pump and a thermostat. As shown in FIG. 2, this conventional engine cooling arrangement 10 includes a water pump 12 whose impeller 12*a* is rotatably housed in an impeller chamber 14. The impeller chamber 14 is formed in an impeller chamber section 16A integral with and forming part of a timing (front) cover 16. The water pump impeller 12*a* is driven through a pulley and belt drive. The timing cover 16 is mounted to the front face F of the cylinder block B, and covers a rotation transmission mechanism (not shown). In an inlet passageway section 16B of the timing cover 16, a coolant inlet passageway 18 leads to the inlet 14*a* of the impeller chamber. A thermostat 20 thermally controls the flow of the cooling water from the radiator to the water jacket of the cylinder block. The thermostat 20 has a heat sensor section 20*a* disposed in the inlet passageway 18. A coolant passageway 22 allows coolant from the radiator to flow to the inlet passageway 18 when a valve section 20*b* of the thermostat 20 opens. Another coolant passageway 24 from a heater and a bypass passageway 26 from the water jacket of the cylinder block are each directly connected to the inlet passageway 18. A coolant outlet passageway 28 connects an outlet 14*b* of the pump impeller to the cylinder block B, passageway 28 being part of outlet section 16C of the timing cover 16.

The operation of the conventional cooling arrangement will now be described. Coolant from the radiator is suppliable through the thermostat valve section 20*b* into the inlet passageway 18 and thereafter sucked into the pump impeller chamber 14. The coolant discharged from the water pump 12 is recirculated through the outlet passageway 28 to the water jacket of the cylinder block B. Coolant discharged from the water jacket is fed to the radiator and the heater. When the engine is cold, coolant discharged from the water jacket is recirculated to the inlet passageway 18 bypassing the radiator in order to assist warm-up of the engine. The inlet passageway 18 is formed straight to enable the engine cooling arrangement to be easily produced by die-casting.

FIG. 3 illustrates a conventional thermostat, where a frame 37 having a flange 32 secures the components of a thermostat 30, so that a main valve 33 is held by a spring 35 and a bypass valve 39 is held by a spring 38. A wax element 36 is secured to the frame 37 by a stop ring 34. The wax element 36 drives a piston 31 with a lift amount of the piston 31 being proportional to the temperature sensed by the wax element 36.

The conventional cooling arrangement does not respond quickly to the change in temperature of the coolant as the engine warms up and does not mix bypass flow (hot coolant) with cold coolant from the radiator. Hysteresis and overshoot result from the coolant temperature changing when flowing through the cylinder block after the valve action of the thermostat, and a lack of stability results.

U.S. Pat. No. 5,503,118 granted to Hollis discloses a temperature control system having a water pump in a housing with flow restrictor valves. The electronically controlled restrictor valves are kept closed to retain the coolant in the cylinder head, and are then activated when the engine has sufficiently warmed-up in order to permit coolant flow into the engine block. The valves are controlled by a computer so as to maintain the sensed oil temperature at an optimum value.

U.S. Pat. No. 5,715,776 granted to Seidl discloses a cooling system having a water pump, and a thermostat for selecting the coolant flow to either a radiator or the water pump. The flow path of the circulating coolant forms a particular pattern through the cylinder block that depends upon the temperature being either below or above the thermostat's predetermined opening point.

U.S. Pat. No. 5,113,807 granted to Kobayashi discloses a thermostat and cooling pump assembly arranged at a side position of an engine for communicating a heat exchanger with the engine cooling jacket. The thermostat is positioned between ends of the engine and adjacent the heat exchanger.

U.S. Pat. No. 5,216,984 granted to Shimano et al. discloses a thermostat housing provided integrally in an end portion of one of the cylinder heads that is bounded by the water pump. The water pump has a sprocket that is driven by the timing chain.

U.S. Pat. No. 4,662,320 granted to Moriya discloses a water pump directly coupled to the engine's cam shaft.

U.S. Pat. No. 5,992,755 granted to Kuse discloses a thermostat that has a pressure equalizing hole in its flange, and increases the lift-up rate at low temperature by reducing a return spring constant and reducing a seal spool thickness. Also, a higher lift increasing rate results in an increase in coolant flow rate and a lowering of upper limit coolant temperature. The thermostat seeks to decrease the upper limit temperature of the coolant.

U.S. Pat. No. 5,970,927 granted to Suzuki discloses an apparatus for circulating cooling water to an engine body, a radiator, a heater core, and an oil cooler. A connecting point, between the oil cooler cooling water communicating passageway and the heater core cooling water passageway, is located upstream of a thermostat-type flow control valve. A second thermostat-type flow control valve is located adjacent a radiator and operates at a significantly lower temperature. The configuration and action of the various flow control valves allows the heater core to remain unaffected by the flow of cooling water through the oil cooler.

The conventional cooling arrangements do not respond quickly to the change in temperature of the coolant as the engine warms up and do not mix bypass flow (hot coolant) with cold coolant from the radiator. The conventional activation of thermostats only indirectly controls coolant valves after the coolant has passed through separate passageways and through an engine. A disparity between the hot and cold coolant temperatures causes abrupt reaction to sudden temperature differentials that can result. Hysteresis and overshoot result from the coolant temperature changing when flowing through the cylinder block after the valve action of the thermostat, and a lack of stability results.

SUMMARY OF THE INVENTION

The present invention provides a thermostat, system, and method for achieving an improved control of cooling in an internal combustion engine. Mounting the thermostat at the inlet side of an internal combustion engine ensures a relatively larger flow of coolant into the bypass and enables reduction of the range of coolant temperature distributions in the water jacket when the thermostat valve is closed.

A significant advantage is obtained by stabilizing coolant temperatures. It is an object of the present invention to provide a minimum of overshoot and hunting by a thermostat that acts to stabilize the coolant temperature by opening and closing. Another object of the invention is an improved temperature control of an air conditioning system. A further object of the invention is a reduced hysteresis in a thermostat's controlling action. A still further object of the invention is an improved radiating efficiency of a radiator.

To achieve these objects, a thermostat according to the present invention controls coolant flow of an internal combustion engine, the thermostat arranged in a housing where coolant from the radiator and from the bypass passage are mixed so as to control flow of the coolant from both passages by the use of valve means. The thermostat is assembled in a water pump case in order to integrate the parts into a single structure. A heat-responding element of the thermostat device and a valve body are individually arranged adjacent the water pump impeller. The heat responding element of the thermostat device is arranged downstream of the water pump impeller, while the valve body is located upstream, and a valve actuating means is located so that the downstream heat responding element effects an actuation of the upstream valve means. The heat responding element is located in a surface parallel with the axis of the water pump impeller.

The thermostat according to the present invention mixes bypass flow (hot coolant) and cold coolant from the radiator in the thermostat housing. The housing includes a water pump impeller, a heat responding element, and flow control valves. By utilizing a main valve and a bypass valve that are located upstream from a heat responding element, according to one embodiment, a mixing of coolants in a mixing area of the thermostat is directly controlled by the heat responding element.

The performance characteristics of the invention improve over conventional devices by making contact separately later.

BRIEF DESCRIPTION OF THE DRAWINGS

The above objects and other advantages of the present invention are described in a preferred embodiment thereof with reference to the accompanying drawings in which.

DETAILED DESCRIPTION OF THE PREFERRED EMBODIMENT

Figure 1A:
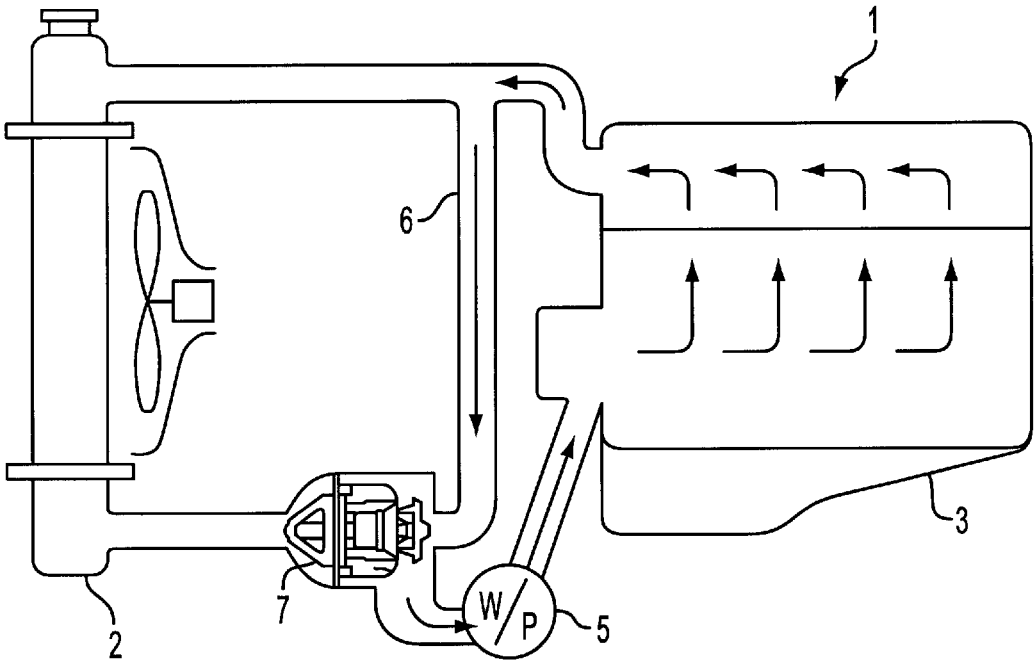
FIG. 1A (PRIOR ART)
FIG. 1A is a schematic diagram of a conventional cooling system in a thermostat closed state.
Figure 1B:
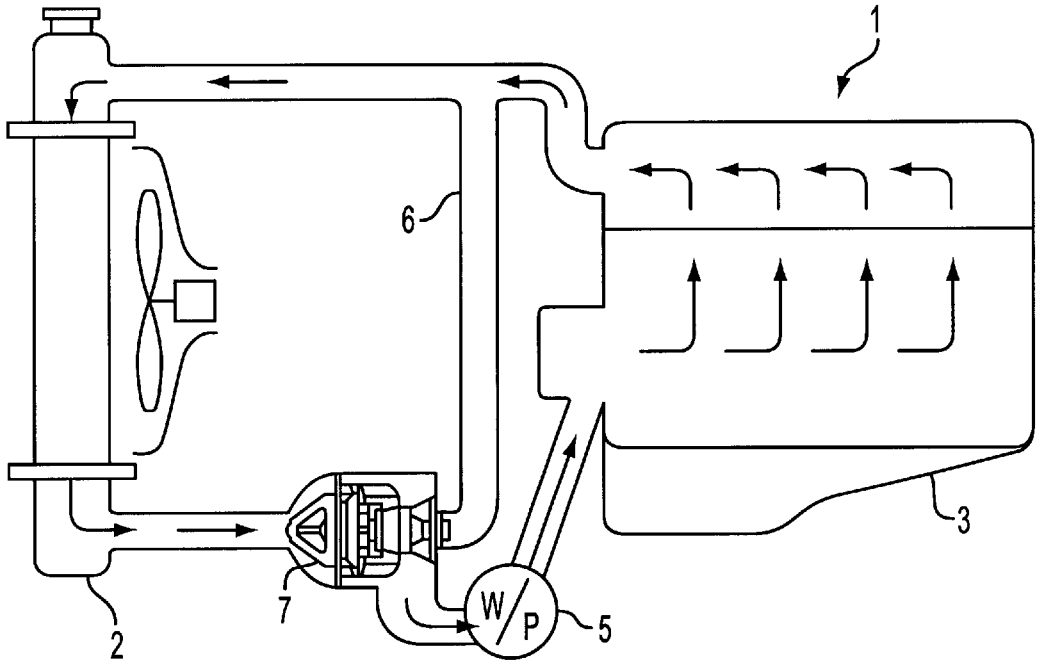
FIG. 1B (PRIOR ART)
FIG. 1B is a schematic diagram of a conventional cooling system in a thermostat open state.
Figure 2:
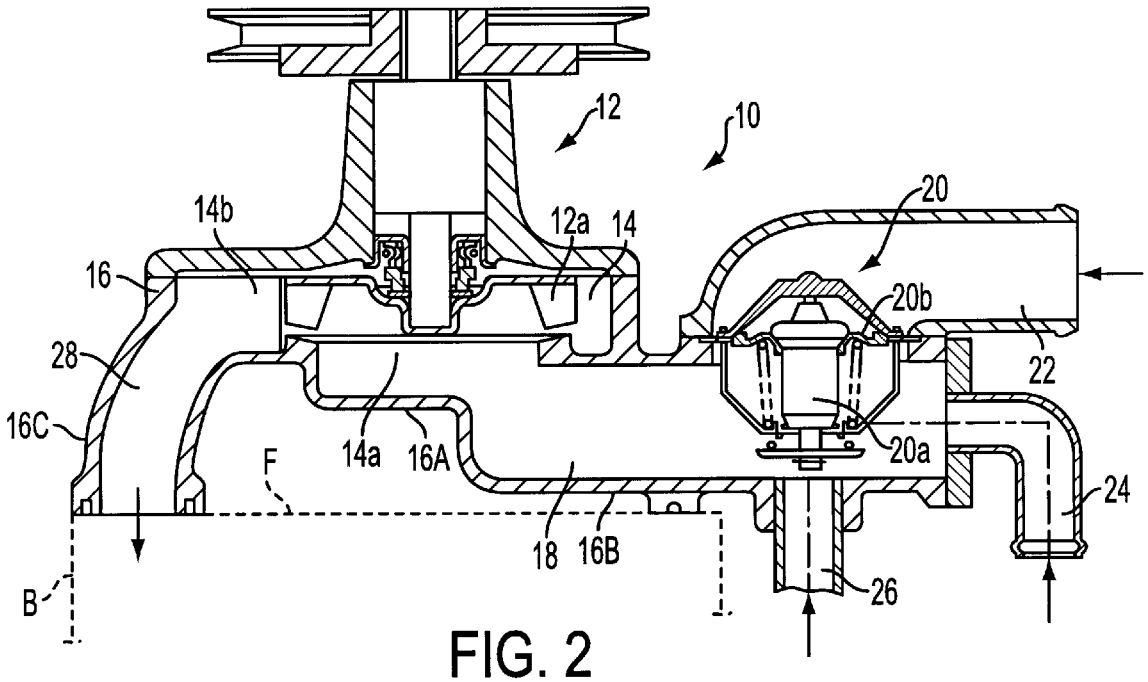
FIG. 2 (PRIOR ART)
FIG. 2 is a cross sectional diagram of a conventional arrangement of a water pump and thermostat in a one-piece structure.
Figure 3:
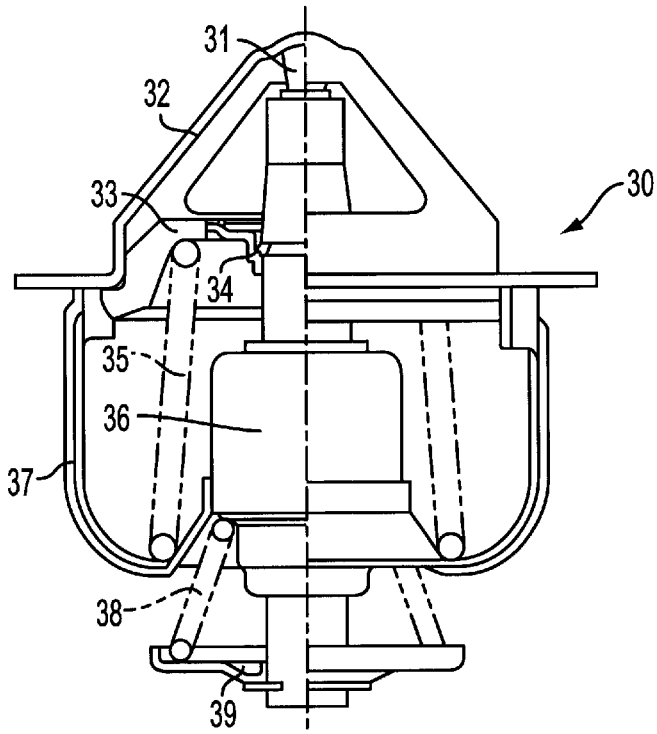
FIG. 3 (PRIOR ART)
FIG. 3 is a cross sectional diagram of a conventional thermostat.
Figure 4A:
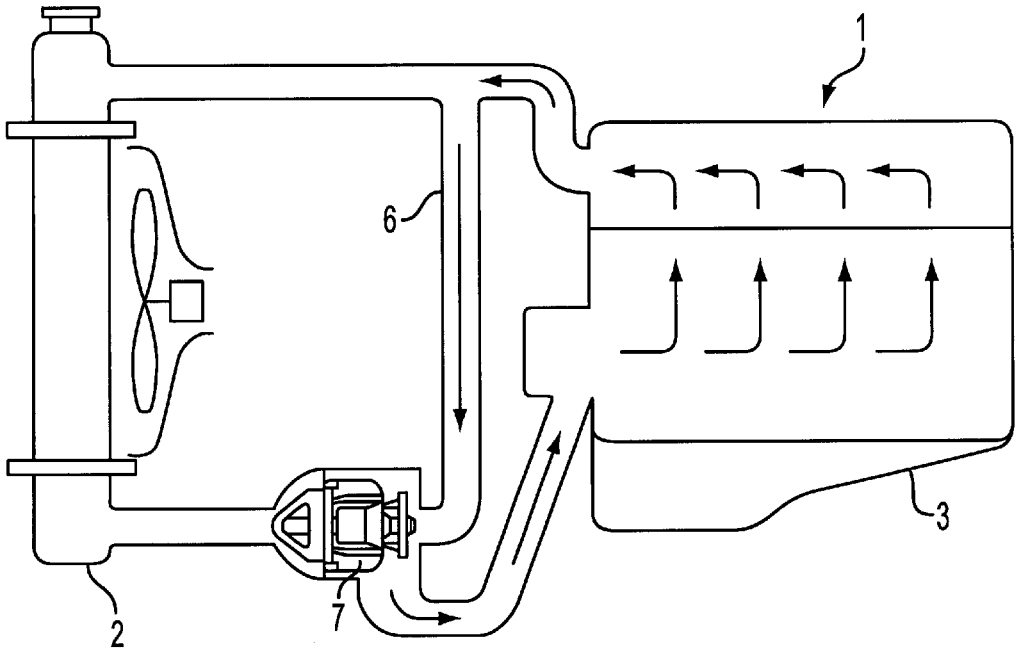
FIG. 4A is a schematic diagram of a cooling system in a thermostat closed state according to the present invention.
Figure 4B:
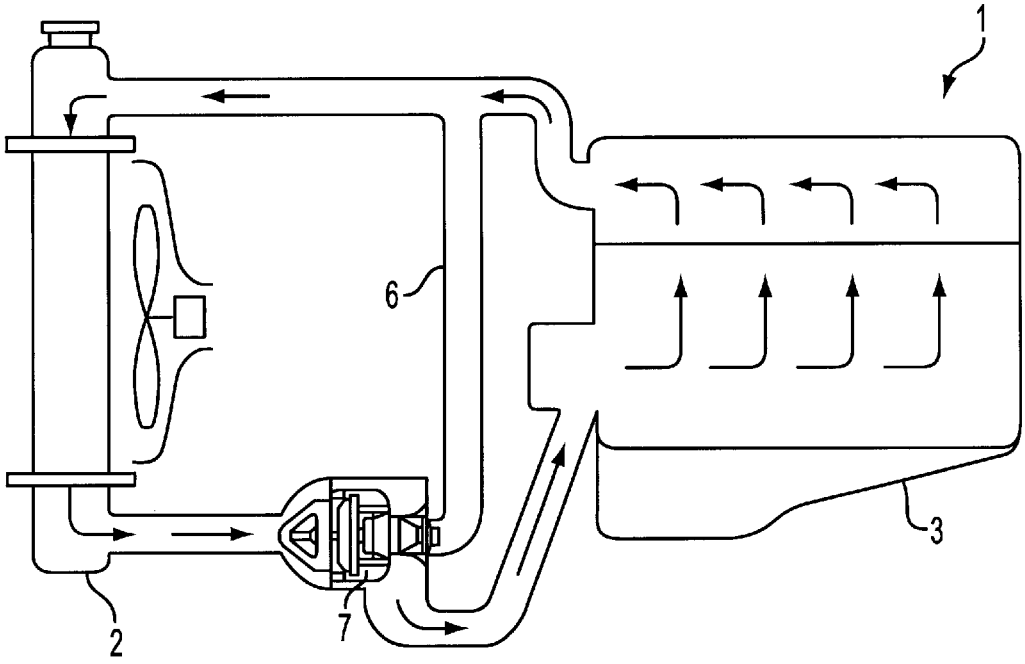
FIG. 4B is a schematic diagram of a cooling system in a thermostat open state according to the present invention.

As shown in FIGS. 4A, 4B, a cooling system 1 includes an engine 3 connected to a radiator 2 and to a bypass passage 6. A thermostat 7 according to the present invention is able to adjust a coolant flow between a fully closed thermostat position and a fully open thermostat position. When the coolant reaches a valve opening temperature of approximately 76.5 to 88° C., the thermostat 7 opens according to a characteristic curve as shown, for example, in FIG. 6. Once the thermostat 7 is in the fully open position, maintaining a coolant pressure of approximately 98 to 176.5 kPa (pressure difference) keeps the thermostat fully open.

Figure 5:
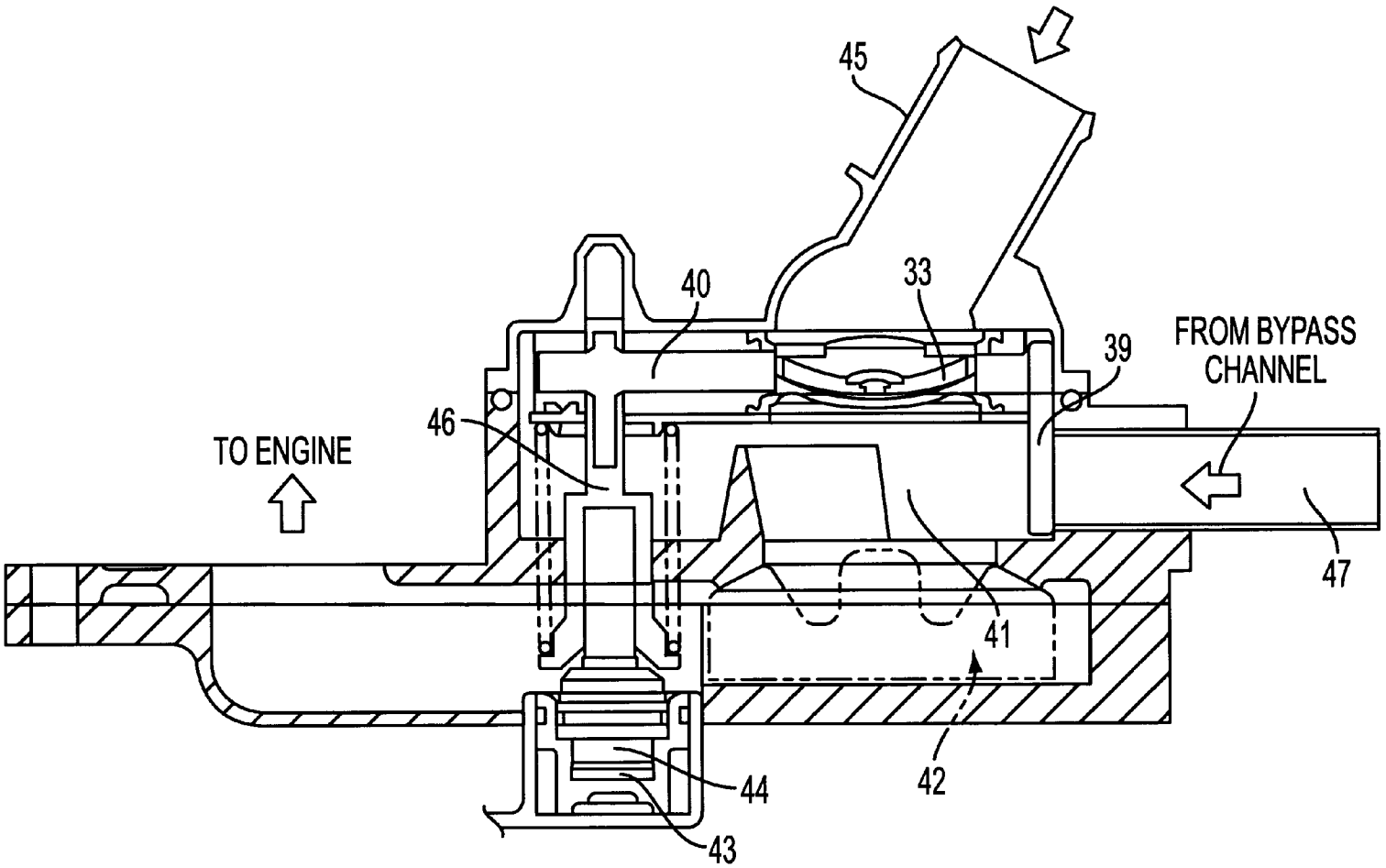
FIG. 5 is a sectional side view of a thermostat according to the present invention.
Figure 6:
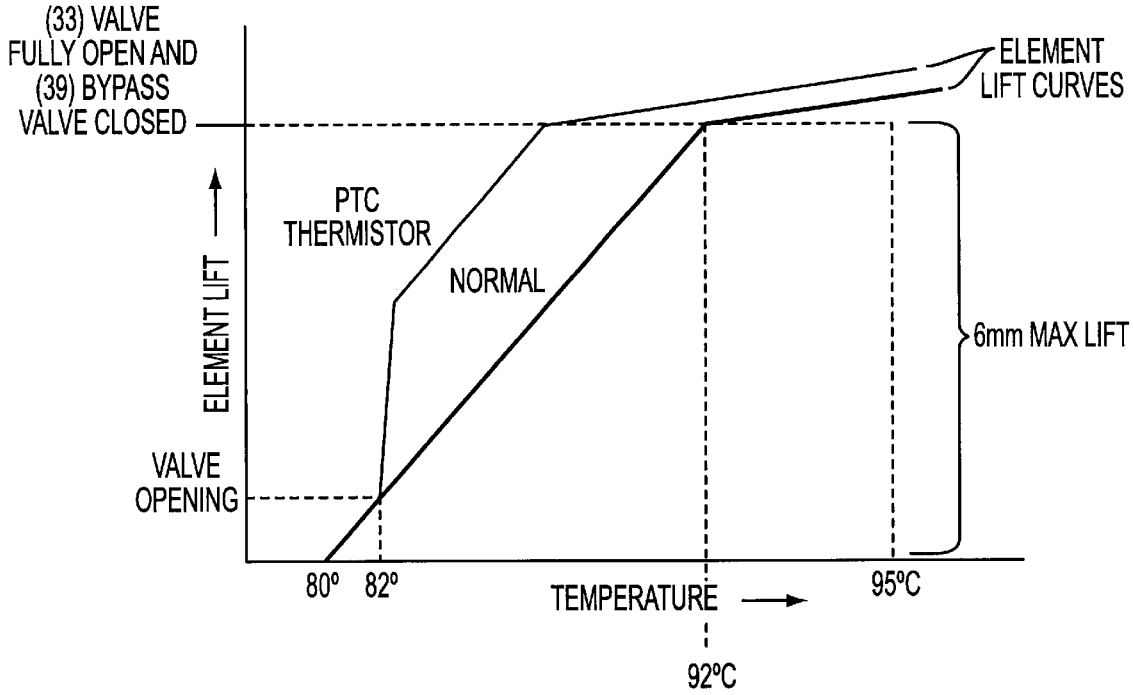
FIG. 6 is a graph showing a relationship between valve opening lift and valve opening temperature according to the present invention.

As shown in FIG. 5, an embodiment of the present invention includes an integrated housing 45 having an impeller 42 disposed between valves 33, 39 and sensing elements 43, 44. A linkage 40 causes the main valve 33 to open when the piston 46 of the heat responding element 43, 44 is extended by the lift experienced by the wax type element 44. The linkage 40 may be a lever arm, a rotating rod, or similar mechanism. The amount of lift, as shown in the example of FIG. 6, is essentially proportional to the coolant temperature. The "lift" is the mechanical output from the wax element 44, or a measure of the extension of a piston, and determines the degree to which the butterfly valve 33 rotates.

Figure 7:
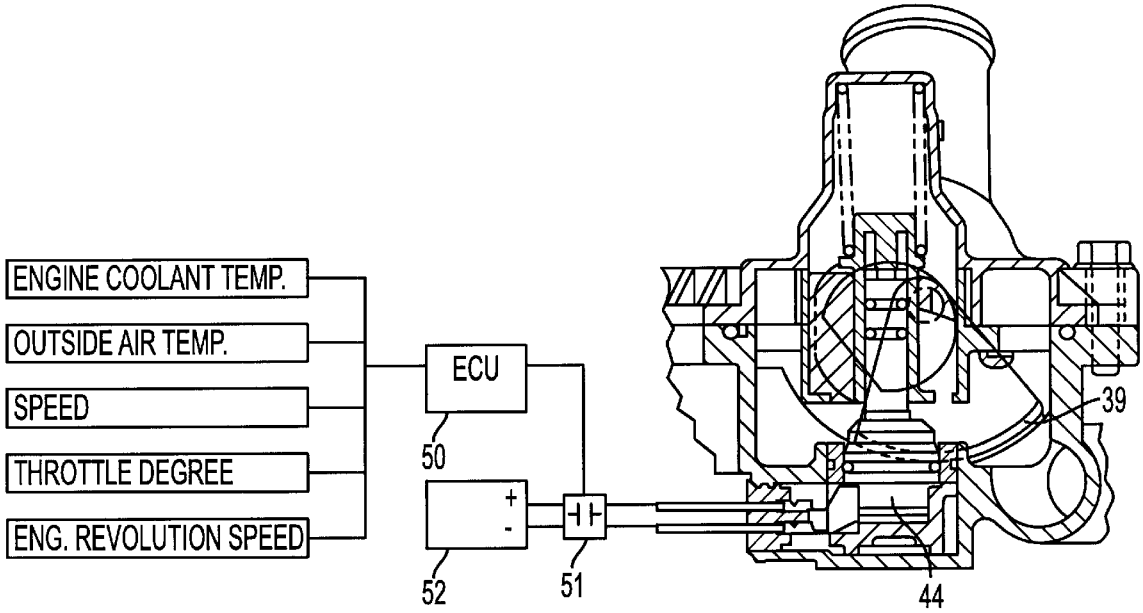
FIG. 7 is an end view of a cross section shape of a thermostat according to the present invention, also illustrating a typical attachment of associated electronic control and electrical supply to a PTC element.

The wax element 44 can also be heated up by the Positive Temperature Coefficient (PTC) thermistor 43, which generates heat by being charged by electricity supplied from an Electronic Control Unit (ECU) 50 as shown in FIG. 7. The rotation of the butterfly valve 33 thus relates to the length of expansion of the wax element 44 expanded by heat from PTC thermistor 43.

The lift characteristic as illustrated in FIG. 6 is chosen to meet the engine system cooling requirement. Under normal conditions, the lifting characteristic of the wax element 44 is designed to allow the butterfly valve 33 to open slowly in order to allow the cabin heater to work quickly. For example, the lifting characteristic for the preferred embodiment is approximately 1 degree Celsius per minute. When the wax element is heated to approximately 80 degrees Celsius by the engine coolant, the piston of the wax element 44 starts to be proportionally raised to the engine coolant temperature.

The coolant temperature can increase quite rapidly, especially when a driver suddenly accelerates the car or drastically revs up the engine. When the coolant temperature increases very quickly, the ECU 50 automatically detects such a change and energizes the PTC thermistor 43 to open the butterfly valve 33 in order to quickly provide more coolant flow for cooling down the engine. As shown in FIG. 6, the amount of lift and the corresponding amount of opening of the butterfly valve 33 increase much more quickly in the mode where the PTC thermistor 43 is used, compared to the "normal" mode where the expansion of the wax element is only due to the heat of the coolant.

An additional feature allows more coolant flow to be provided by a feed-forward control system in the event the ECU 50 detects unusual engine loads. In such a system, the thermostat valve opens at a temperature lower than the normal predetermined temperature.

A bypass valve 39 can be attached to the linkage 40 so that, as the thermostat reaches the designed lift, the bypass valve 39 closes the bypass passage 47 and diverts the coolant flow to the radiator. The mixing area 42 mixes the bypass flow (hot coolant) and cold coolant from the radiator in the thermostat housing 45. The impeller 42 transmits the mixed coolant directly to the heat responding element 43, 44, so that the feedback and response of the flow control is direct. That is, there is virtually no lag in the response of the valves 33, 39 because the coolant does not travel all the way through the engine before a mixture is varied. The linkage 40 can include a cam or cam follower (not shown) so that an offset may be added to the opening and closing of the valves 33, 39. Alternatively, electronic or hydraulic control of the valves is envisaged, where a dampening or adjustment of the relative action of the main valve 33, compared with the bypass valve 39, can be effected and varied.

Figure 10:
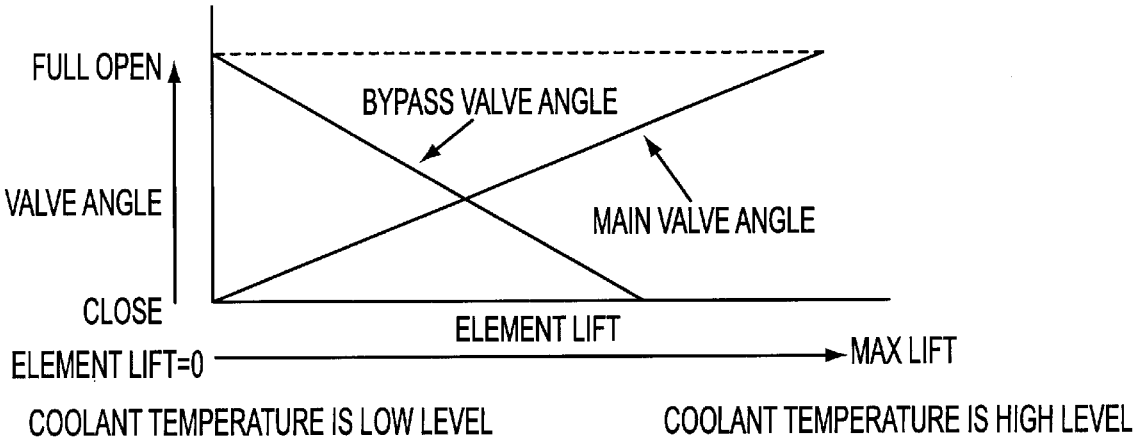
FIG. 10 is a graph showing a relationship between valve angle and amount of opening lifts, for the main valve compared with the bypass valve, according to the present invention.

The flow rate downstream of each of the valves is adjusted by the valves' respective openings, in a reciprocal action. As shown in FIG. 10, the bypass valve 39 is closed earlier than the main valve 33. The diameter of the main valve is larger than the diameter of the bypass valve 39, so that the corresponding valve angles of the respective valves change between open and closed positions according to different rates. High temperature and low temperature coolant are thus mixed by the actions of each valve. The temperature of the coolant going into the engine is thereby kept constant by the interaction of the heat responding element and the valves. By maintaining a controlled flow rate, the bypass valve 39 is closed when the butterfly valve 33 is open and vice-versa, and the valves move together continually to maintain the constant temperature. The correspondence between the two valves' amount of opening can be directly inverse or can be adjusted by means of cams or other use of mechanical offset, or by delay imposed hydraulicly or electronically. By disposing the heat responding element downstream of the water pump impeller, accurate control is achieved.

Figure 8:
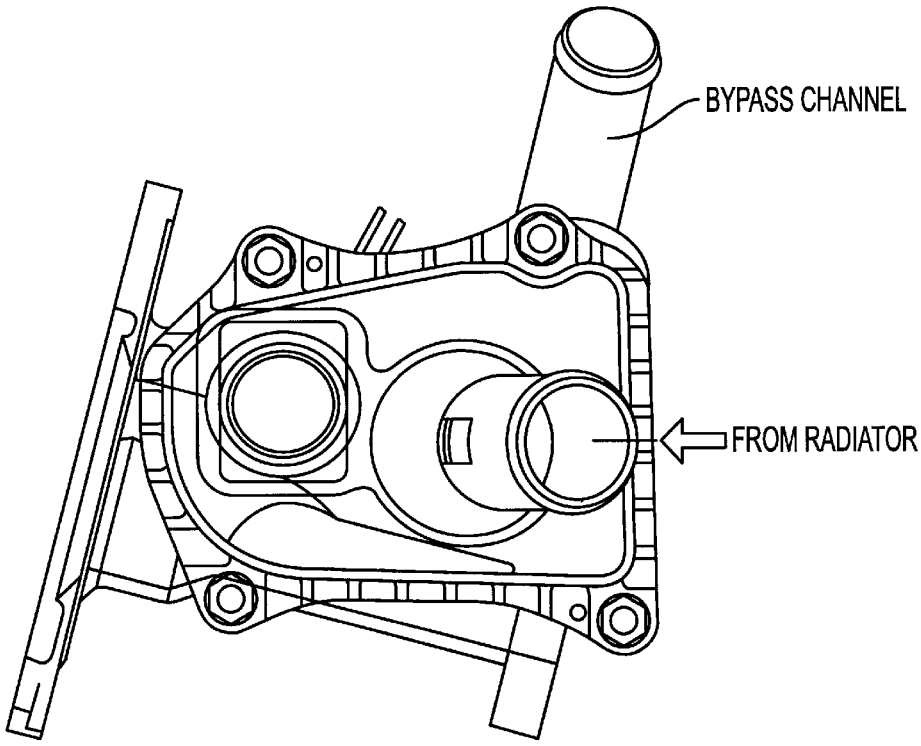
FIG. 8 is an end view appearance drawing of an embodiment of the present invention, showing relative positions for coolant channels.
Figure 9:
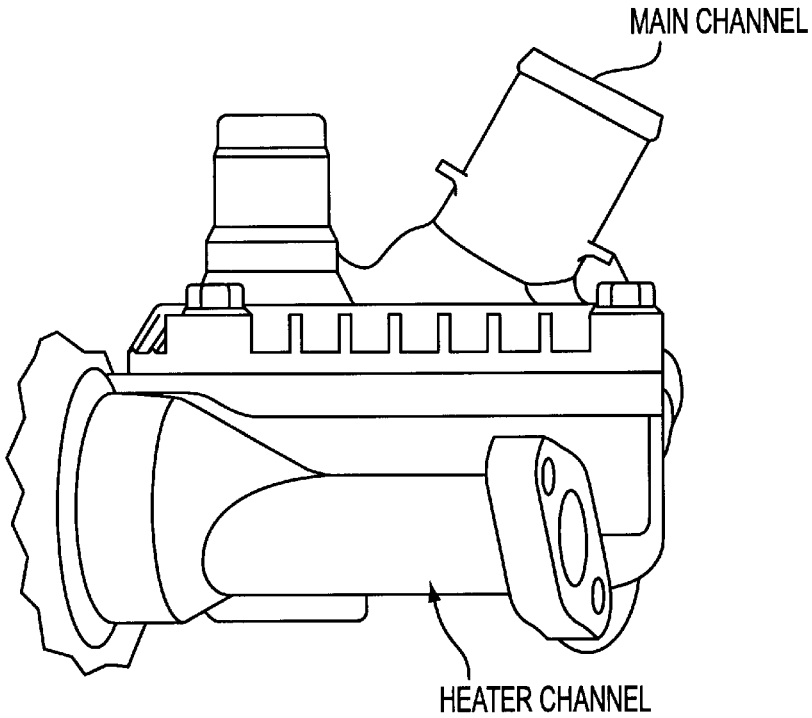
FIG. 9 is a side view appearance drawing of an embodiment of the present invention, showing relative positions for coolant channels.

As shown in FIG. 7, an ECU 50 energizes the PTC thermistor 43 by activating a relay 51, thereby supplying electrical power from the battery 52 to the PTC thermistor 43 when the ECU determines that additional cooling is required. FIGS. 8 and 9 illustrate additional views of the preferred embodiment, including a typical mounting configuration.

Although the invention has been described and illustrated for exemplary embodiments thereof, it should be understood by those skilled in the art that the foregoing may be varoiusly modified to include changes and omissions, without parting from the spirit and scope of the present invention.

What is claimed is:

1. A thermostat that controls coolant flow into an internal combustion engine, comprising:

a housing comprising an upstream end, a downstream end, and a mixing area where coolant from a radiator and from a bypass passage are mixed, wherein said mixing area separates said upstream end from said downstream end;

a plurality of valves disposed in said upstream end of said housing for controlling flow of said coolant entering said upstream end from both said radiator and said bypass passage; and a heat responding element disposed in said downstream end of said housing, said heat responding element operative to control said plurality of valves according to a temperature of said coolant in said downstream end of said housing.

2. A thermostat, comprising:

a housing where coolant from a radiator and from a bypass passage is mixed;

a water pump having an impeller, the pump disposed inside said housing;

a heat responding element disposed downstream from said impeller, said element detecting a temperature and having a piston that extends when said temperature is greater than a predetermined value;

a linkage connected to said piston;

a main valve disposed upstream from said impeller, said main valve connected to said linkage so that the extension of said piston causes said main valve to open in proportion to an amount by which the detected temperature exceeds said predetermined value, said coolant from said radiator being allowed to flow when said main valve is open; and a bypass valve disposed upstream from said impeller, said bypass valve connected to said linkage so that the extension of said piston causes an adjustment of an opening of said bypass valve, said coolant from said bypass passage being allowed to flow when said bypass valve is open;

whereby said mixing controls the flow of said coolant.

3. A thermostat as claimed in claim 2, wherein said temperature is a temperature of said coolant in said housing.

4. A thermostat as claimed in claim 3, wherein actuation of said heat responding element causes said valves to direct an increasing flow of said coolant through said radiator.

5. A thermostat as claimed in claim 2, wherein the total coolant flow through said valves is controlled by a reciprocal action of the valves.

6. A thermostat as claimed in claim 2, wherein said thermostat controls coolant flow into an internal combustion engine, said thermostat further comprising:

a control unit for detecting an increased load on said engine or a rapid increase in a temperature of said coolant; and a heating element for rapidly heating said heat responding element in response to a control signal from said control unit.

7. A thermostat as claimed in claim 6, wherein said heating element is a thermistor.

8. A thermostat as claimed in claim 6, wherein said housing is mounted adjacent a coolant inlet passage of said engine.

9. A thermostat as claimed in claim 6, wherein actuation of said heating element effects rapid operation of said valves to direct an increasing flow of said coolant through said radiator.

10. A thermostat that controls coolant flow into an internal combustion engine, comprising:

a housing comprising an upstream end, a downstream end, and a mixing area where coolant from a radiator and from a bypass passage are mixed, wherein said mixing area separates said upstream end from said downstream end;

a plurality of valves disposed in said upstream end of said housing for controlling flow of said coolant entering said upstream end from both said radiator and said bypass passage;

a heat responding element disposed in said downstream end of said housing, said heat responding element operative to control said valves according to a temperature of said coolant in said housing sensed by said heat responding element;

a control unit for detecting an increased load on said engine or a rapid increase in a temperature of said coolant; and a heating element for rapidly heating said heat responding element in response to a control signal from said control unit.

11. A thermostat as claimed in claim 6, wherein said heating element is a thermistor.

12. A thermostat as claimed in claim 6, wherein said housing is mounted adjacent a coolant inlet passage of said engine.

13. A thermostat as claimed in claim 6, wherein actuation of said heating element effects rapid operation of said valves to direct an increasing flow of said coolant through said radiator.

14. A method of regulating a coolant temperature in an internal combustion engine, comprising:

inputting coolant, from both a radiator and a bypass passage, upstream from a main valve and a bypass valve;

detecting a temperature at a first location;

opening said main valve upstream of said first location when said detected temperature is greater than a predetermined amount, so that said coolant flows through said radiator in proportion to an amount by which said detected temperature exceeds said predetermined amount;

adjusting said bypass valve upstream of said first location when said detected temperature is greater than said predetermined amount, thereby adjusting a flow of said coolant through a bypass passage;

mixing said coolant according to said detected temperature.

15. A method as claimed in claim 10, further comprising electrically adding heat to said first location in order to speed-up said opening and adjusting of said valves.

16. A method as claimed in claim 11, wherein said electrically adding heat is in response to a detected increased load on said engine.

* * * * *